US010443172B1

(12) United States Patent
Weiner

(10) Patent No.: US 10,443,172 B1
(45) Date of Patent: Oct. 15, 2019

(54) COMBINED YARN CARPET IMPROVEMENTS

(71) Applicant: Robert S. Weiner, Atlanta, GA (US)

(72) Inventor: Robert S. Weiner, Atlanta, GA (US)

( * ) Notice: Subject to any disclaimer, the term of this patent is extended or adjusted under 35 U.S.C. 154(b) by 425 days.

(21) Appl. No.: 15/430,680

(22) Filed: Feb. 13, 2017

Related U.S. Application Data

(63) Continuation-in-part of application No. 15/235,798, filed on Aug. 12, 2016, now Pat. No. 10,273,617, which is a continuation of application No. 14/160,123, filed on Jan. 21, 2014, now Pat. No. 9,416,466.

(60) Provisional application No. 61/791,241, filed on Mar. 15, 2013, provisional application No. 62/217,251, filed on Sep. 11, 2015, provisional application No. 62/278,575, filed on Jan. 14, 2016.

(51) Int. Cl.

| | |
|---|---|
| ***D05C 15/16*** | (2006.01) |
| ***D05C 15/18*** | (2006.01) |
| ***D05C 17/02*** | (2006.01) |
| ***D02G 3/28*** | (2006.01) |
| ***D02H 1/00*** | (2006.01) |

(52) U.S. Cl.
CPC ..... *D05C 15/18* (2013.01); *D02G 3/28* (2013.01); *D02G 3/283* (2013.01); *D02H 1/00* (2013.01); *D05C 15/16* (2013.01); *D05C 17/023* (2013.01)

(58) Field of Classification Search
CPC ..... D05C 15/16; D05C 15/10; D05C 15/20; D05C 15/04
See application file for complete search history.

(56) References Cited

U.S. PATENT DOCUMENTS

| | | | | |
|---|---|---|---|---|
| 3,875,883 | A * | 4/1975 | Eberwein | B65H 49/16 112/475.08 |
| 5,224,434 | A * | 7/1993 | Card | D05C 15/30 112/475.23 |
| 5,706,642 | A * | 1/1998 | Haselwander | D01H 1/10 57/264 |
| 6,098,392 | A * | 8/2000 | Tung | D02G 3/24 57/11 |
| 8,443,743 | B2 * | 5/2013 | Christman, Jr. | D05C 15/34 112/470.01 |
| 2002/0029554 | A1 * | 3/2002 | Belcher, Jr. | D02G 1/20 57/333 |

* cited by examiner

*Primary Examiner* — Tajash D Patel

(74) *Attorney, Agent, or Firm* — Stephen J. Stark; Miller & Martin PLLC

(57) ABSTRACT

Different combining techniques are employed for directing multiple yarns through a single needle of a tufting machine. Different aesthetic appearances be achieved which provide for many new design opportunities in the marketplace.

14 Claims, 6 Drawing Sheets

COMBINED YARN CARPET IMPROVEMENTS

CLAIMED PRIORITY

This application is a continuation in part application of U.S. patent application Ser. No. 15/235,798, filed Aug. 12, 2016; which in turn claims priority to U.S. patent application Ser. No. 14/160,123 filed Jan. 21, 2014, which claims the benefit of U.S. Provisional Application No. 61/791,241 filed Mar. 15, 2013, the benefit of U.S. Provisional Application No. 62/217,251 filed Sep. 11, 2015; and U.S. Provisional Application No. 62/278,578 filed Jan. 14, 2016, all of which are incorporated herein by reference in their entirety.

FIELD OF THE INVENTION

The present invention relates to improvements for making and using joined yarn with carpet.

BACKGROUND OF THE INVENTION

Companies such as Volkmann and others make yarn twisting machines for twisting yarns together for use in making carpet. These machines are often called twisters. Twisters typically operate at a speed of about 75 yards per minute. Twisters are traditionally manufactured to twist two yarns together at a specified rate of twist, whatever that twist rate might be. Two strands are kept under common tension and the twisters perform the desired effect.

While traditional twisting certainly has its uses, other uses of twisters and/or twisted yarn are believed to be desirable in the marketplace.

For instance, some designers are particular about the look of finished carpet. You may have a particular shade of blue provided as a sample product but the designer may want a different shade. With dyeable yarn then the carpet can be tufted and dyed to a particular shade. However, with solution dyed yarns, another sample run and then finished product would typically need to be made for the designer to proof and then buy.

To date, no one has known to provide a striated look with solution dyed yarns other than by using raised and submerged technologies of a computer driven tufting machine. To the extent there are striated looks available in the marketplace, they are done with either piece dyed or batch dyed yarn processes. Accordingly, when someone dumps bleach or a highly stainable material on the carpet, a noticeable imperfection is provided on those carpet.

Creel patents, such as U.S. Pat. Nos. 5,531,392 and 5,613,613 have been used to provide some striated patterned carpets, however, utilizing such technology is extremely unpractical for solution dyed yarns. In order to change the look of a finished product, one would likely need to completely restring the creel which would be an extremely cumbersome practice not likely to be performed by carpet manufacturers. In fact, when the applicant owned those two patents, he never attempted to use solution dyed yarn for such a practice. All carpets produced using that technology were done using piece dyable and/or skein dyable yarn to then be dyed after the tufting of the carpet to desired patterns. Depending on the particular dyes utilized, different carpet colorations could be provided. At least some colorations could be determined after the tufting process. However, one disagreeable aspect to these type yarns is that if a stain is attempted to be removed, such as by bleaching and/or use of other harsh chemical procedures, permanent discoloration of the carpet can occur.

Additionally, although two (or more) yarns fed to a single needle, there was no effort made to intentionally vary the orientation of yarns or the rate of twist per inch over a given length, especially in an effort to provide significantly less net twist over a longer length of yarn than a gross twist over a shorter segment of that longer length (at least on average).

Remember, a disadvantage of dyable yarn whether it be piece dyed or it be space dyed or skein dyed, is that should the carpet be then subjected to a stain or a bleach, an imperfection is then provided in the affected area. Solution dyed yarn is much less susceptible to bleaches or stains or ultraviolet light or ozone.

Improved methods of twisting yarns together and then using twisted yarns with tufting machines needles so that multiple yarns can pass through a single needle are believed to be desirable in the carpet industry.

SUMMARY OF THE INVENTION

A present object of many embodiments of the present invention is to provide twisted yarn and/or methods of twisting yarn for use with carpets.

It is another object of many embodiments of the present invention to provide an improved method of manufacturing carpet of twisted yarn.

It is another object of many embodiments of the present invention to provide an improved carpet construction when at least two yarns are directed through a single needle having a twist differential between the two yarns.

It is another object of at least some embodiments of the present invention to provide an improved carpet construction wherein a twist differential (i.e., by way of example, one yarn having a high twist as defined as four or more twists per inch such as 4.5, 5.5, 7 twists per inch, etc.) of at least two filaments in a first yarn and a second yarn having a low twist as defined as less than four twists per inch among at least two filaments. Typically, high and low twist yarns are heat set after twisting to assist in maintaining the twist after tufting.

Furthermore, for at least some embodiments, a first yarn is preferably a high luster yarn combined (through twist) with a more de-lustered yarn for at least some embodiments.

For at least still other embodiments, a yarn twist differential could exist between two yarns in the carpet design whereby a first yarn has a first twist per inch, and a second yarn has a second twist per inch lower than the first twist per inch. The differential or twist differential gives rise to at least one functional and aesthetic characteristic.

In addition to twist differential, at least some embodiments provide a high luster with a low luster yarn. Still at least some other embodiments use a high twist heat set, preferably solution dyed yarn in combination with a no twist (not heat set) yarn.

Measuring luster can be difficult as it is a light reflectivity. Luster is characteristic somewhat independent of color. No carpet company is known by the applicant to twist yarns of different lusters together.

For still other embodiments, a color of carpet can be changed by using a solution dyed base color yarn which is the same throughout a series of carpets which is then twisted together with an accent solution dyed yarn to create a desired overall color of the finished carpet through the selection of the accent yarn(s).

It is another object of at least some embodiments to utilize unbalanced tension on a twister so as to create different effects of yarn when it is run through needles to tuft carpet.

It is another object of many embodiments of the present invention to provide extremely low twist per inch on a twister such as a half turn per inch instead of something more along the lines of six twists per inch.

It is another objects of many embodiments of the present invention to utilize a twister, warper and/or other equipment, to provide on a single pass a three ply or four ply yarn from component yarns.

Additionally, it is an object of many embodiments of the present invention to provide a warper to combine multiple ends together in a twisted manner. Warpers can operate at speeds on the order of ten times faster than a twister such as around six to eight hundred yards per minute as opposed to 75 yards per minute which is a huge increase in speed.

Still some other embodiments can impart a random twist rate to yarn to create striation effects in carpet. Striation can be produced using at least, a twister, beams, a creel, and/or a warper. Striation can also be achieved with piggy backing yarns through a single needle, directing yarns from different beams to a single needle, cabling yarns together and/or other techniques.

Still other embodiments may twist or combine together at least a pair of yarns with a twister or other device with a known twist rate, and then combine another yarn which joins the twisted yarns at some point at or before an eye of a needle of a tufting machine. The third yarn could be twisted with the pair or alternatively join the pair in a somewhat random twist arrangement such as feed from a tube bank with the twisted pair, etc. The third yarn could be twisted or otherwise joined or paired with a fourth yarn before or after joining up with the twisted yarn pair of at least the first and second yarns. A fifth yarn could be joined in similar or dissimilar manners.

While twisting is described in the above paragraph, some of the yarns could additionally (or alternatively) be cabled, piggy backed, provided from more than one beam supply, warped together and/or otherwise be joined for a variety of effects.

Accordingly, in accordance with the presently preferred embodiment of the present invention, a number of twisting or joining methods and techniques can be employed for use in making twisted and/or joined yarn for use with carpets. First, a twist differential carpet design can be manufactured. Specifically, at least first and second yarns may be directed through a single eye of a needle in manufacturing carpet and/or in adjacent needles.

It is an object of some presently preferred embodiments of the present invention to provide improved solution dyed carpet configuration.

It is another object of many embodiments of the present invention to provide an improved carpet having solution dyed yarns predominantly throughout, having at least one tuft row with an intentionally provided striated appearance of at least some random direction.

It is another object of many embodiments of the present invention to provide a predominantly solution dyed carpet having a unique and randomized yarn arrangement. These can be distinguished from piece, skein, or space dyed carpets. Harsh chemical treatment can be applied to solution dyed carpet without removing the underlying coloration of the yarns, while harsh chemicals tend to bleach out piece, skein, or space dyed carpets thereby providing discoloration.

Accordingly, according to a presently preferred embodiment of the present invention an improved carpet configuration is provided in which at least first and second yarns are provided together in a non-uniform, or random arrangement together through a single needle such as could be performed with a twister, a warper, or other methodology so that when the yarns are tufted through a single needle of a yarn, they provide one of a plurality of possible striated looks across the surface of the carpet due to a non-uniform twist pattern, joining or combining.

Non-uniform twisting can be performed in many ways whether it is a core cabling technique, a winding technique using a winder, a twisting technique using a twister, or other techniques so as to preferably be able to provide the yarns together in a non-uniform manner whether that be random, or even a reversing manner where it is a right hand twist followed by a left hand twist such as over a predetermined length whether over less than 20 feet or less than 10 feet with a twist pattern preferably less than about one twist per foot or maybe a higher twist such as one twist per inch but more likely one twist per 18 to 24 inches is more likely, or even less. Randomization (i.e., changing orientations of the three or more yarns) either with or without varying twist rate can be provided in many embodiments as well.

For some embodiments, the direction twist preferably changes such as going from right hand twist to left hand twist approximately within every twenty feet if not every ten feet, although the rate of twist might be larger or smaller over specific segments. In addition to first and second yarns, there may also be preferably third and fourth yarns which provide a striation pattern parallel to the first and second yarns with a tuft row which could be similar or dissimilar in twist construction through a second needle. A fifth yarn could be provided through a third needle to provide a uniform tuft row parallel to tuft rows created by the first and second needles.

Additionally, in addition to the appearance of randomized patterns or orientation of at least two yarns along a tuft row, the yarns could also be tufted to multiple elevations which give yarn an additional effect as a result of the striation patterns.

As the yarns of the carpet are solution dyed as opposed to piece dyed or skein dyed, these yarns are virtually impervious to stain and bleach. Accordingly, in the event they are spilled upon with aggressive solvents and/or stains and/or bleach, they are extremely resistant to stain as opposed to the piece dyed or stain dyed goods which are quickly blemished.

In addition to the carpet construction design, the method of producing the carpet is believed to be novel.

Accordingly, in accordance with the presently preferred embodiment of the present invention, a twist differential carpet design can be manufactured as provided for some embodiments. Specifically, at least first and second yarns may be directed through a single eye of a needle when manufacturing carpet and/or in adjacent needles. These two yarns may be running side by side, if not parallel, may be twisted, may be cabled, may be core cabled, or other methods of providing yarns through a single or multiple needles in such embodiments. The first yarns may, or may not, be a high twist yarn as defined as having at least four twists per inch. The second yarn may, or may not, be a low twist yarn comprised of less than four twists per inch. By combining these two yarns together, an unexpected result of having a higher durability over a linear relationship between the amounts of higher and lower twist yarn can be achieved while providing a more economical carpet product with higher performance than would otherwise be expected. Furthermore, a different aesthetic appearance is provided than if all high twist yarns are used. This is also different when utilizing all lower twist yarn in that a higher durability can be experienced over prior art construction.

When utilizing multiple yarns 14-18 through a single needle 12, one may do this in multiple fashions whether it be parallel feeding, twisting, cabling, core-cabling such as shown in co-pending application Ser. No. 14/160,123, incorporated herein by reference, or other technologies whereby multiple yarns would be simultaneously fed through a single eye 20 of a needle 12. All these type configurations of the present construction are believed to provide an aesthetic look which differs from prior art configurations. Specifically, the present embodiments preferably use pre-dyed yarns such as solution or skein dyed yarns as first and second yarns 16,18.

First and second yarns are preferably dyed before tufting, such as solution dyed yarns or skein dyed yarns. Furthermore one of the first and second yarns may have no twist at all for at least some embodiments.

Other twist differential carpet designs may have at least one if not two or more twists per inch differential between first and second yarns (i.e., three twists per inch vs. five twists per inch, etc.) whether or not they are high and low twist, both high twist, both low twist or one of each.

Furthermore, for some embodiments, utilizing high luster yarn for the first twist yarn and a low luster yarn for a second twist yarn, still further aesthetic effects can be achieved than have been previously experienced in prior art constructions. First and second twists could be the same or different twist rate (such as higher, lower, high or low). Flat yarns could be utilized for some yarns and/or no twist yarns could be utilized as well giving rise to still additional embodiments.

While utilizing multiple yarns to a single needle as a presently preferred embodiment, it may be possible for other embodiments to utilize a single yarn end through each needle with adjacent needles providing the first yarn and second yarn respectively for at least some embodiments which can still achieve the increased durability of something similar to a high twist (or higher twist) yarn construction while providing a lower weight and thus easier to install product and also a more economical product for the carpet manufacturer with yet a different aesthetic appearance than has been achieved with prior art constructions.

Whereas a 50-50 ratio of high twist and low twist yarns was utilized for a test embodiment, the expected characteristics would be a durability factor also referred to as a wear index or carpet performance rating of half way between that of the high twist yarn and the low twist yarn like the carpet density. This was not the case. In fact, the durability factor has been found to be at least 10% higher than that of the calculated linear amount thereby providing an unexpected result over prior art constructions.

Bright luster yarns such as yarn having a reflectivity of more than 10%, 20% or greater than a lower luster yarn could be utilized. Still other embodiments may employ at least 30% greater brightness of the brightness yarn compared to low luster yarns. Still others may require 50% brighter for at least some embodiments.

Many preferred embodiments utilize a twister to twist the bright luster yarn with a low luster yarn.

Additionally, a new effect when twisting yarns together is provided for at least some embodiments. An ability to blend solution dyed yarns to create different colors is now understood. Specifically, a base yarn is utilized to produce a carpet pattern as is known in the art. This base yarn is twisted with one of a plurality of different accent colors at the twister so that when using solution dyed yarns the color of the finished carpet is changed by the selection of the accent color(s). For instance, by varying the color of the accent yarn and utilizing a tan base color yarn, such as the difference between a gray and a brown accent yarn, the carpet can change from being very gray to being very brown based on the twist of the yarns and the color of the accent yarn(s) selected.

Other abilities could be the ability to change between two different colors. For instance, if two different blues are utilized for the accent colors, the effect of the tufted carpet can be found to be quite different by alternatively using the two accent colors. By utilizing this technique, a specific overall color of the tufted carpet can be selected. A designer can effectively match a color recommendation while utilizing solution dye (i.e., not dyeable yarns but yarns already dyed) to provide the precise coloration desired by an end user or the designer. This effect is not known to have ever been done in the carpet industry while maintaining a base color yarn. Accordingly, an accent color could be added as a third (fourth or fifth yarn) to a pair already being directed to a single eye of a needle, whether twisted together at a predetermined twist rate, in one of a variety of techniques as described herein or otherwise, Additionally, when utilizing a twister such as the Volkmann twisters and others, uniform tension is normally provided by twisted yarns. The applicant has developed a system of purposefully providing unbalanced tensions between two yarns being fed to a twister so as to create additional effects in the end carpet. A tweed look can be provided. A tension can be provided on one yarn tighter than another when being twisted either for their entire length or switched to then be oppositely applied, such as with a processor, or otherwise to create a very different looking tweeded look. Other effects may also be provided as would be understood by those of ordinary skill in the art in practice. A first twisted pair or trio can be combined with another single yarn or pair as described herein or otherwise to pass through a single needle eye together for similar or dissimilar effects.

Furthermore, on a twister, the rate of twist can be extremely reduced in an attempt to provide better striation.

On a twister, the applicant has developed a way for at least some embodiments utilizing a single pass through the twister to ply together at least three yarns. The applicant does not know of any successful efforts to utilize twisters such as the Volkmann twister technology for which two yarns are directed to the twister. The applicant has also developed a way to run more than one yarn from each of the two stations to the twister which is believed to have never been done in the prior art.

Additionally, at least one other improvement for use with yarns in carpet is the ability to use a warper to combine at least two ends together. This is a particularly attractive option as the warper can be run at a speed of roughly ten times that of a twister and therefore be utilized to twist yarns to provide a desired twist rate.

Additionally, while the ability to feed one yarn through the cone of another yarn is covered by U.S. patent application Ser. No. 14/160,123, the applicant has first developed a way of rotating one of those yarns about the other during feeding to increase the rate of twist. This feature is also believed to be novel.

Finally, a warper or other device can be used to twist at random twist rates for at least some embodiments to provide "striated" patterns.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
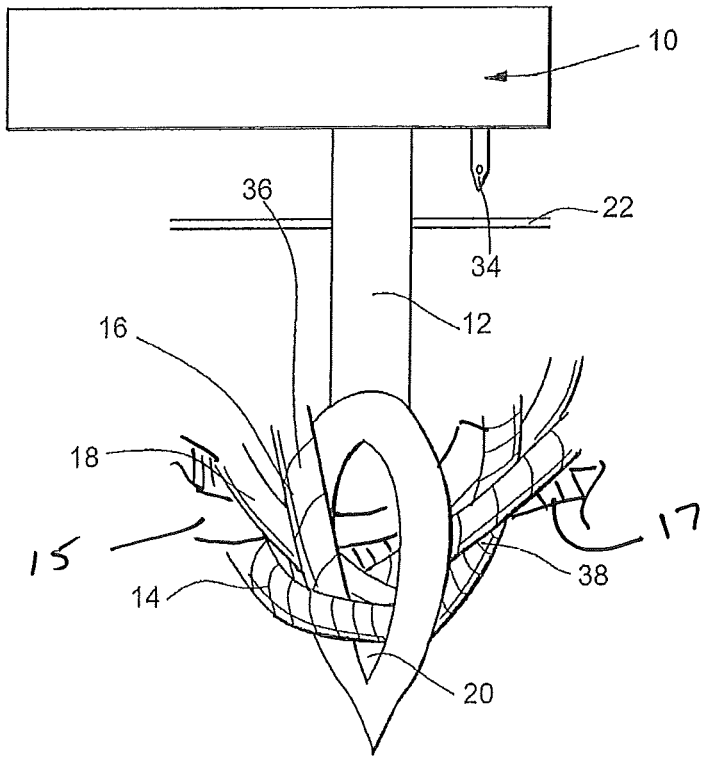
FIG. 1 is a perspective view of a portion of a tufting machine tufting at least first and second yarns through a backing.

FIG. 1 shows a presently preferred embodiment of the present invention of a tufting machine 10 with an exemplary first needle 12 which will have at least one if not a plurality of yarns illustrated as first yarn 14, second yarn 16, and/or third yarn 18, fourth yarn 15 and fifth yarn 17 directed through an eye 20 of a needle 12 for at least some embodiments. More yarns than three can be run with some embodiments through a single needle 12. Other embodiments may have only a single yarn such as first yarn 14, second yarn 16, or third yarn 18 directed therethrough as will be explained in further detail below. First yarn 14 is illustrated as having a higher twist per inch than second yarn 16. Second yarn 16 may have no twist, or virtually no twist, for at least some embodiments. Third yarn 18, if utilized, could be a high, low or no twist yarn style. Flat yarns could be employed as any of first through fifth yarns 14,16,18,15,17. Four or more yarns 14,16,18 of at least one twist differential could be used with other embodiments.

While tufting with tufting machine 10, first and second yarns 14,16 can be tufted in a single location with a single needle 12 as shown in FIGS. (1, including yarn 18) and 2. It is also possible that a single yarn 14 first yarn 14, second yarn 16, and/or third yarn 18 (or more, such as fourth or fifth yarn 15,17) can be tufted side by side and is also shown in FIG. 2 through adjacent needles 12,34 as would be understood by those of ordinary skill in the art through backing 22 in order to create a design.

First yarn 14 is shown as a high twist yarn as having four or more twists per inch in one embodiment of component filaments 38. Second yarn 16 is shown as a low twist yarn as one having less than four twists per inch of component filaments 38. Third yarn 18 could have high, low or no twist (as illustrated). Fourth yarn 15, etc., could have high, low or no twist as could fifth yarn 17. Other embodiments may have other twist differentials. Furthermore, for at least some embodiments, first yarn 14 has a higher twist than second yarn 16 (i.e., lower twist) such as at least about one or two twists or more per inch more than the second yarn 16. For some embodiments, this could mean first yarn 14 could have six twists per inch and the second yarn 16 could have four twists per inch, etc. In such embodiments the yarns could both be high twist yarns. Both could be low twist yarns (or, one could have three twists per inch, the other or twist per inch, etc.). Furthermore, one could be high twist and one could be low twist yarns. Second yarn 16 could also have no twist for at least some embodiments. Additionally, second yarn 16 (or any of the other yarns 14,18) may not be heat set for some embodiments. For at least some embodiments, it is desirable for no-twist yarns to not be heat set. On the other hand, high twist yarns such as first yarn 14 or others could be heat set. A combination of high twist heat set yarns with no twist, not heat set yarns has been found to provide better performing carpet than would be expected, while still being effective. Wear testing, such as performed under ASTM D 5252, ASTM D 5417, D 6119 Foot Traffic or other testing can show better performing carpets than would be expected as explained below.

Figure 2:
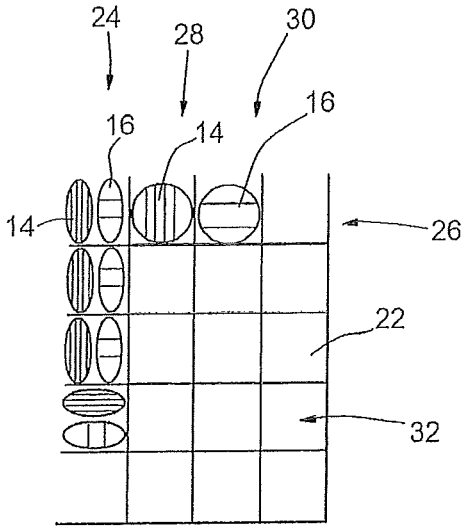
FIG. 2 shows a top plan view of a portion of a carpet design in accordance with a presently preferred embodiment of the present invention.

The applicant has discovered that the wear rating or wear index of one of a carpet tufted with a first yarn and a second yarn such as a 50-50 ratio could be achieved either in the first column 24 shown in FIG. 2 such as by those having first and second yarns 14,16 tufted through a single needle 12 or as also shown in first row 26 in second and third columns 28,30 such as would be accomplished by adjacent needles 12,34. The applicant has discovered very interesting properties of the carpet 32 tufted by such a process. Specifically, while a density of the carpet 32 changes linearly by the weight of the first yarn 14 compared to the second yarn 16 in ordinary relationship, the durability does not change along the similar linear relationship as would be expected. In fact, on a 50-50 blend of the first and second yarns 14,16 whether introduced through a single needle 12 or adjacent needles 12,34 the applicant discovered that the durability or wear factor is greater than the linear relationship that would otherwise provide.

For instance, if the density of a carpet design 32 using all higher twists 14 were 5.0 and the density of using all low twists 16 were 4.0, the density of the carpet design 32 would be 4.5 of a 50-50 mix. However, if the wear rating of the high twist carpet design 32 were 4.0 and the wear rating of the carpet design 32 utilizing just the lower twist yarn 16 is 3.0, one would similarly expect that the durability factor would be 3.5. This is not the case as discovered by the applicant. The applicant has found that the durability factor is at least 3.6 or at least about 20% greater than the corresponding increase in density. For many embodiments, the applicant has even found that the durability factor increases for a 50-50 blend is at least approximately about 10%, if not about 30% or almost 40% higher than expected or more like the high twist yarn than the low twist yarn. Even more impressive results can be experienced when one of the yarns is a no twist yarn.

For a 30-70 blend one may expect a weighted average such as 4.0×(0.3)+3.0(0.7)=3.3. However, once again, at least approximately about a ten percent, if not about twenty, thirty, or forty percent above the weighted average for the wear rating can be experienced with the preferred embodiment. Other embodiments also experience these unexpected above weighted average wear ratings.

Not only does this allow for the use of less material for a higher quality product than would be anticipated, the applicant has also further discovered that an attractive aesthetic appeal can be provided which has not previously been provided in the marketplace because the twist differential also gives rise to an aesthetic look which is not known to have ever been provided in the marketplace even by adjacent needles 12,34 or by directing multiple yarns 14,16 and or 18 and/or others through a single eye 20 of a needle 12.

When utilizing multiple yarns 14-18 through a single needle 12, one may do this in multiple fashions whether it be parallel feeding, piggy backing, twisting, cabling, core-cabling such as shown in co-pending application Ser. No. 14/160,123, incorporated herein by reference, or other technologies whereby multiple yarns would be simultaneously fed through a single eye 20 of a needle 12. All these type configurations of the present construction are believed to provide an aesthetic look which differs from prior art configurations. Specifically, the present embodiments preferably use pre-dyed yarns such as solution dyed yarns as first and second yarns 16,18.

It may be possible that one of the first, second and third yarns 14,16,18 has a higher twist than the other two or that two or more yarns such as 14,18 have a higher twist than second yarn 16, etc.

The applicant has found that a twist differential of at least about one or two twists per inch, if not more, gives rise to a perceivable aesthetic and/or functional difference.

Additionally, the applicant has discovered that a high twist product such as of about four or more twists per inch can be relatively easily distinguished from a lower twist such as one having three twists per inch or less. In such a case, the twist differential may be as low as one for at least some embodiments but still give rise to a difference than not only aesthetics but also into the performance of the tufted carpet as shown on the figures.

It should also be noted that the first and second yarns 14,16 could be selected as having the same or similar density with a different twist rate and thereby still provide a twist differential. The wear rating of such embodiments has also been found to not merely be the same linear relationship between the twist differences of a carpet 32 formed completely of the first yarn 14 or the second yarn 16 in the linear relationship. Instead, the resulting carpet 32 has been designed to have a greater performance or wear rating than the anticipated results by at least 10%, if not about 20% or more.

Accordingly, applicant believes that twist differential is desirable in many embodiments.

Furthermore, for at least some embodiments, the higher or high twist as defined by four or more twists per inch or even a higher twist yarn such as first yarn 14 may be a high luster yarn and the lower twist yarn 16 may be a low or lower luster yarn (or vice versa) to still give even further aesthetic appearance to at least some embodiments. Still other design and/or functional aspects can be incorporated in this technology as would be understood by those of ordinary skill in the art.

In a similar manner, FIG. 1 could also show first, second, third yarns 14,16,18 and/or fourth and fifth yarns 15,17 as being of different lusters as opposed to twists. A bright luster yarn could be twisted with a low luster yarn with at least a 10% brightness difference if not 20%, 30% and 50% brightness difference in the yarns as would create quite different effects. Luster can be somewhat dependent, but also dependent of color as would be understood by those of ordinary skill in the art. For instance, using the same color with different luster qualities is believed to be normal in addition to using different luster with different twist rates, high and low twists, and/or even different colorations.

Flat yarns could make up any of first through fifth yarns 14,16,18,15,17 as could no twist yarns. While two yarns have been routinely directed through a single needle, whether twisted or joined through the process of the Creel patents of U.S. Pat. Nos. 5,531,392 and 5,613,613, adding the third 18, fourth 15 or fifth yarns 17 is not a normal procedure to proceed through a single eye 20 of a needle 12.

The applicant has discovered that first and second yarns 14,16 can be twisted, cabled, or otherwise joined meaning fed or combined together, whether as a twisted pair with one of a predetermined twist rate along the entire length, a changing twist rate, and/or a random twist rate, or as joined yarns as could be combined in a similar or dissimilar manner as the Creel type patents of U.S. Pat. Nos. 5,531,392 and 5,613,613. In none of the applicant's preferred embodiments are any of the yarns 14,16,18,15,17 secured to one another before proceeding through the eye 20 of the needle 12. Instead, it may be that first and second yarns 14,16 are twisted, cabled, and/or otherwise run together and then joined with third yarn 18. It may be that first and second yarns 14.16 are twisted, cabled and/or otherwise run together and then that pair is twisted with third yarn 18. It may be that third and fourth yarns 18,15 are twisted, cabled or otherwise run together and then joined with first and second yarns 14,16. It may be that third and fourth yarns 18,15 as a twisted pair are twisted, cabled or otherwise joined with the first and second yarns 14,16 as a twisted pair. It may be that a fifth yarn 17 is either twisted, cabled or otherwise run with or about both pairs of first and second yarns 14,16 and third and fourth yarns 18,15. Fifth yarn 17 could be twisted, cabled run or otherwise joined into the pair having the third and fourth yarns 18,15. Not only can colors of the various yarns 14,16,18,15,17 be different, but the types of yarns whether flat, no twist or twist differential can be employed along with luster differences and/or other difference be employed, or not, amongst the various yarns 14,16,18,15,17 utilized to provide aesthetic and/or other features not present in the marketplace to date.

Twisters can be utilized to provide the yarns directed to the group of yarns 14,16,18 and possibly including either of 15,17 as they are then could be wound about cones, beams or other structures for feeding to the eye 20 of a needle 12. Twisters traditionally are being used by the applicant and rated at about 75 yards per minute. Cabling techniques could also be utilized as could warpers, creels, beams and/or other supplies employed to direct the various yarns 14,16,18,15,17 as desired to a single eye 20 of a needle 12 to create various effects when tufted to become carpet as understood by those in the art.

The applicant has further discovered that when making the carpet such as carpet design 32 blending different yarns can be utilized to create different colors. Specifically, a solution dyed base yarn such as first yarn 14 can be twisted together with a second yarn 16 which could be an accent color of solution dyed yarns. This means that the color of these yarns 14,16 as being set and is relatively unchangeable even with applying additional dye and/or bleach.

Accordingly, in order to change the color of the carpet design 32 with the appearance of the carpet design 32, a number of factors can be changed. First, the rate of twists of the first relative to the second yarns 14,16 can be changed as well as the color of the second yarn 16 relative to the first yarn 14. Normally, the first yarn 14 can be selected as a base color such as could be kept in large quantities by the manufacturer and then depending on which particular color is selected by the customer and/or the designer, the accent second yarn can be selected and/or even third yarn 18 could also be selected so as to create a different and overall look and feel of the carpet design 32 when tufted to have a particular look with the two or three 14,16 and/or 18 twisted, cabled or otherwise joined lengths. The applicant has shown through trial and error that a plurality of shades and effects can be created which have not previously been performed before for coloring carpet design 32. Accordingly, a traditional sample book can be provided using solution dyed carpet, and still if a customer wants a different shade, that shade can be achieved through the twisting, cabling and/or joining of yarns with the accent at least second yarn 16 if not also third yarn 18, in a predictable manner by the carpet company.

Twisters can be utilized to twist the yarns and/or other methods of providing the twisted yarn could also be provided, such as warpers, creels, beams, cabling methodology and/or other techniques.

Figure 3:
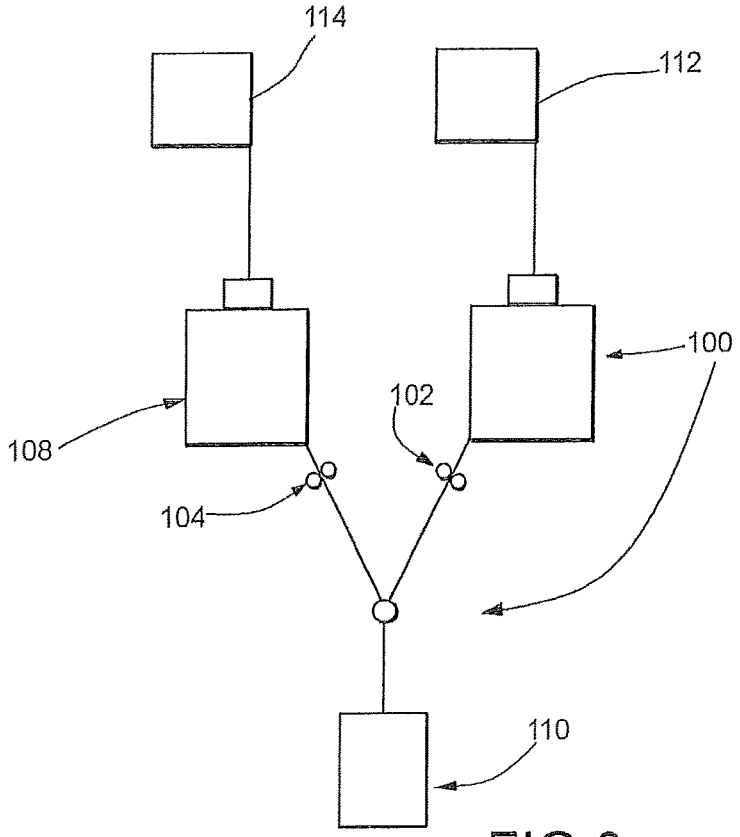
FIG. 3 is a schematic view of a modified twister for performing at least some embodiments of the present invention.

Additionally, when twisting or otherwise joining yarns, which is shown in a schematic in FIG. 3, unbalanced tension can be provided to the twister 100 (or other joining equipment such as warpers, beams, creels, cabling equipment, etc.) such as with tension wheels 102,104 from supplies 106,108 so that twisted yarn 110 has a different effect than the traditional twisting of twisting yarns under common tension. By providing an unbalanced tension, quite a different look can be obtained as has been obtained with prior art constructions. Furthermore, the amount of tension applied by the tension devices 102,104 can be changed for still further effects of the yarn 110 is created. The time of tension could also be changed (the entire yarn 110 need not be provided under a uniform set of tensions by tension devices 102,104). Opposite tensions could be applied and/or varying tensions could be applied over various intervals.

Additionally, as is further shown, yarn supplies such as 112 and/or 114 could be fed such as through the supplies 106,108 to then be twisted, cabled, warped and/or otherwise joined together with the yarn supplies 106,108 respectively, and twister 100 to provide (using one of yarn supplies 112 or 114) yarn supply 110. This is not believed to have ever been done to create at least a three ply if not a four ply twist (using both supplies 112 and 114) with a single pass through twister 100. Other ways to provide single passes of at least 3 ply can be performed as well.

Figure 4:
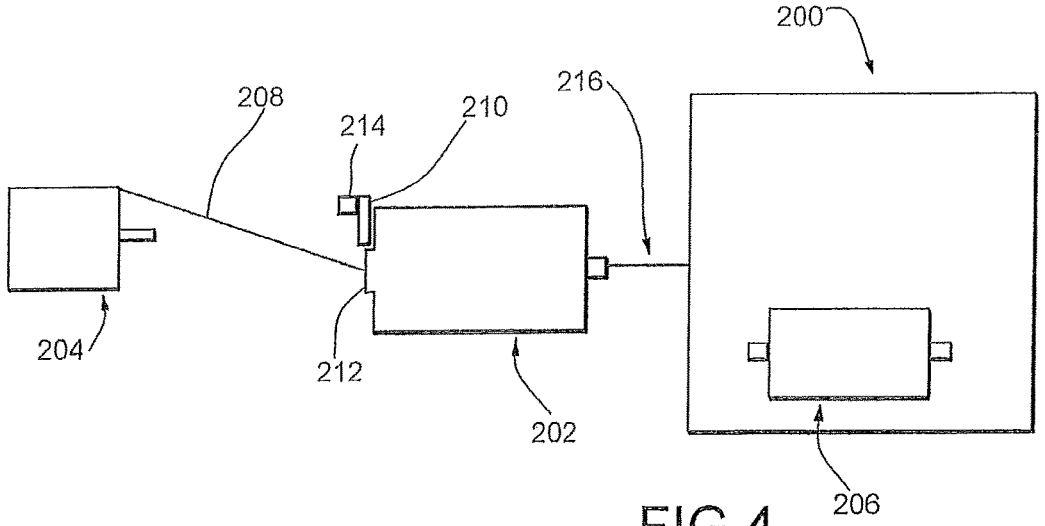
FIG. 4 is a schematic view of a warper performing at least some embodiments of the present invention.

FIG. 4 shows a warper 200 being used in a way not done in the past. Specifically, multiple yarns can be fed from individual cones such as first cone 202 and second cone 204 and then twisted and warped to provide beam 206. No one is believed to have done this in the past.

Additionally, in the context of combining yarns together with twist, what is known with a prior application of the applicant is to run a second yarn supply 204 through a first yarn supply 202 (as explained by the applicant in a copending patent application). However, no one has ever rotated the first yarn supply 202 at the first yarn supply while running a second yarn supply 208 through the first yarn supply 202 such as by using at least one of first and second gears 210,212, the first gear being run by a motor 214 or otherwise so that the twist rate of twisted yarns such as at location 216 is greater than it otherwise would have been without the use of the rotation of the first yarn supply 206. There are certainly other ways that also could be employed to provide a desired rate of twist between at least two if not more than two yarns as well as about one more yarns.

Figure 5:
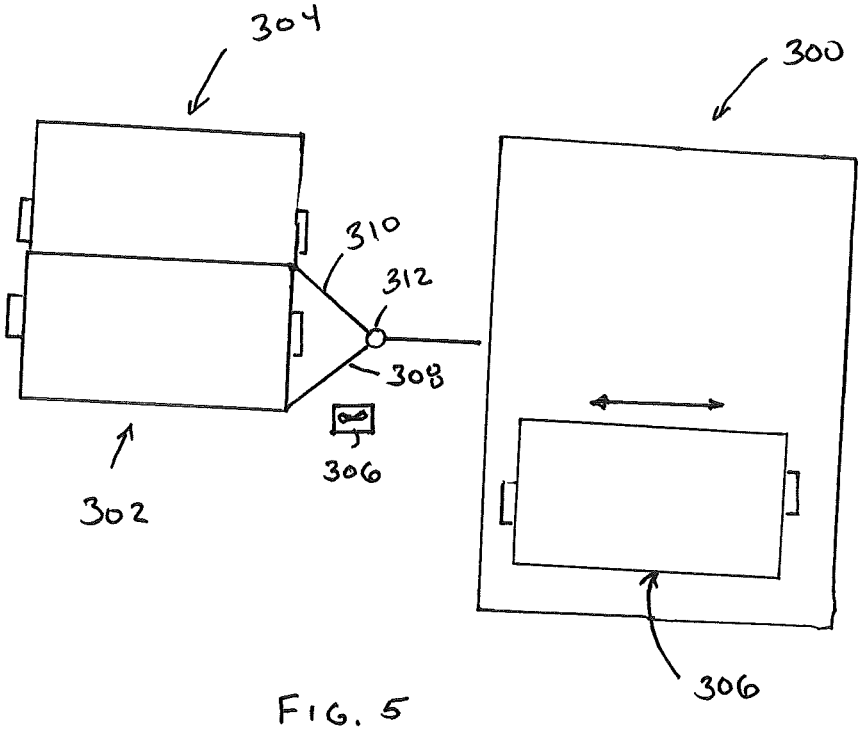
FIG. 5 is a schematic view of a warper performing at least one embodiment of the present invention.

Providing a predetermined twist rate is certainly a desirable feature for twisting yarns together for at least some embodiments. Still other embodiments can benefit by having random twists for at least some embodiments. In particular, FIG. 5 shows one way of providing random twists, or ascending or descending twist rates, with a warper 300. Twisters or other devices could be used with other beam or yarn roll 306 is created such as from at least first and second cones 302,304 (more could be provided with other embodiments) which provide yarns 308,310 to warper 300. As the yarns 308,310 are being fed toward the warper 300 or other device such as twister, feeder bank, etc., one or more fans 306, if utilized, can be directed on yarns 308,310 such as before being joined together at location 316 such as downstream of an eyelet or other location. Threading the warper 300 at high speeds while combining yarns 308,310 in parallel has assisted in creating randomly twisted yarns. The relative position of the yarns 308,310 change relative to one another as they are being fed to and through the warper 300 at location 316 and as being fed into roll 306 to create a striated pattern of random twist when tufted into a carpet. The roll 306 may be oscillated, or not, for various embodiments while warping the roll 306.

While warper 300 is being shown as the instrument of choice, this could certainly be done with a twister or other cabling or joining equipment. Furthermore, although one fan 306 is shown, it would also be understood that more than one fan 306 and others could be utilized. Furthermore, selectively changing the speed of the fan or the direction of air flow against the yarns 308,310 during the joining process.

Figure 6:
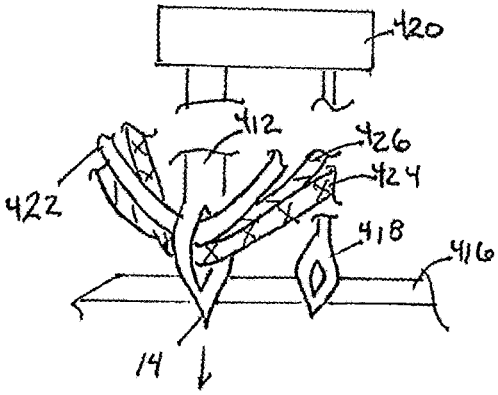
FIG. 6 shows a side plan view of a single needle puncturing through a backing to provide carpet.
Figure 7:
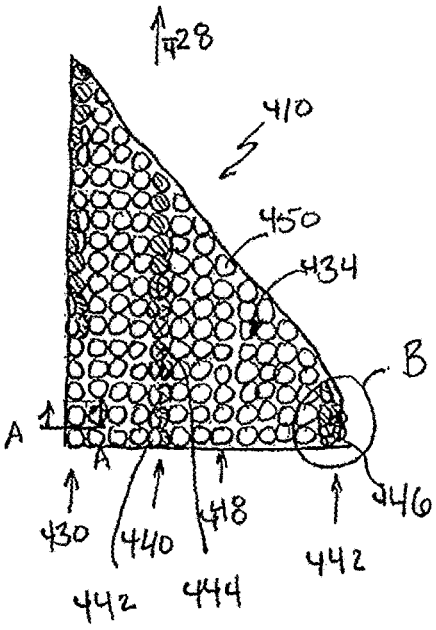
FIG. 7 shows a top perspective view of the presently preferred embodiment of the present invention.

FIG. 6 shows a single needle 412 making a penetration 414 through a backing 416 to construct the carpet 410 of FIG. 7 of a presently preferred embodiment of the present invention.

The yarns proceeding through needle 412, which is shown beside needle 418, could be one of a set of needles as driven by a tufting machine 420 as understood by those of ordinary skill in the art to manufacture carpet 410. The needle 412 is provided with first, second and third yarns 422,424,426 which are solution dyed yarns as opposed to skein, space or piece dyed yarns. Accordingly, these yarns are manufactured to a specific color. The applicant is unaware of any other party utilizing a combination of solution dyed yarns 422, 424,426 in a multiple manner through a single needle 12 when manufacturing carpet 10.

When tufting, tufting machines operate by directing backing 416 in a linear direction such as direction 428 shown in FIG. 7. Accordingly, the first needle 412 is shown providing row 430 of tufts which could contain the three yarns 422-426 as shown in the Figure. FIG. 9 shows this better with 422,424 and 426 proceeding from a single penetration such as first penetration 432 shown in FIG. 8. Depending upon the relative placement or orientation of the yarns 422-426 as they are directed by the needle 412 through the backing 416, one or two of the yarns 422-426 will likely be more prevalent as viewed from above an upper surface 434 after tufting. A third one of the yarns 422-426 if not a second one as well, is likely to be less prevalent once the carpet is tufted and viewed from above. Remember, the yarns 422-426 are preferably not physically joined together at intervals prior to directing through the needle 412. The yarns 422-426 will thus be restrained together at the penetrations 432 as they proceed through the backing 416, but are not otherwise connected together. They are joined together meaning that they proceed through a common penetration 432, but not connected together along lengths of the yarns 422-426 independent of the penetrations 432.

There are various ways to loosely twist yarn in the marketplace. Applicant has copending application Ser. No. 14/160,123 filed Jan. 21, 2014 incorporated herein by reference in its entirety. Twisting can intentionally reverse direction over a length of yarn using various techniques. Furthermore, randomization may also result in an appearance of reversing direction of twist over a length. Randomization may include re-orienting which occurs in yarn bundles 74 having at least three yarns A,B,C with at least one of the yarns changing relative positions relative to the others over a length. See also 62/217,251 filed Sep. 11, 2015, 62/168,001 filed May 29, 2015, and Ser. No. 14/617,054 filed Feb. 9, 2015, and/or 62/217,232 filed Sep. 11, 2015, all of which are incorporated by reference herein in their entirety.

For some embodiments, the applicant is attempting to loosely join separate yarns in a non-standardized twist pattern and/or for the orientation of the yarns 422-426 relative to one another to purposefully not remain uniform over a length of the yarns 422-426. For instance, the yarns 422-426 are not twisted together at one twist for 12 inches repeatedly over and over again with a twister maintaining a predetermined twist rate as traditionally occurs in the art for at least first row 430 of carpet 410, although other rows could have traditionally twisted yarns in parallel rows. Instead, the applicant can change the twist over a length such as over a 20 foot length or over a 10 foot length either by randomization and/or re-orienting such as through a core cabling technique or other techniques, as described herein, so as to be able to create a striated look in the carpet 410. Fans could blow on loose yarns 422-426 as they are relatively slowly wound with a twister, cabling equipment, a warper, joining from different locations, such as from creels, beams and/or other structure, or other equipment to then be possibly wound on a yarn cone for delivery to a needle 412, or other methods, including delivery on to an eye 20 of a needle 12. It is anticipated that the yarns 422-426 may be paired so as to preferentially "striate" as tufted in a "random" orientation before leaving the cone on a creel as provided from a beam or otherwise, for many embodiments. Different creels or beams could be utilized as well.

Figure 11:
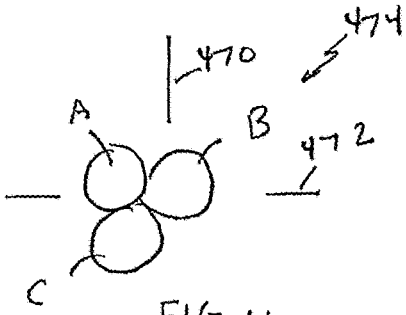
FIG. 11 is a cross sectional view of the yarns shown in FIG. 6 at a first position along a length of yarn.
Figure 12:
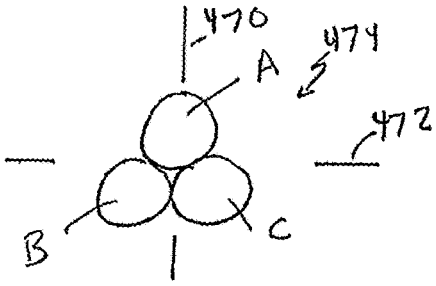
FIG. 12 is a cross sectional view of the yarns shown in FIG. 6 at a second position along a length of yarn.

FIGS. 11 and 12 can help show randomization which can differ from "twisting" in many embodiments, although it certainly can involve twisting in others. A,B, and C represent the three yarns 422-426. If A is 22 in FIGS. 11 and 12 while B is 424, one will see that B is not twisted as would be expected relative to C (26) in FIG. 12. This can occur through loose combining discussed above through various techniques, many of which are described in other applications, such as 62/217,251 filed Sep. 11, 2015, Ser. No. 14/160,123 filed Jan. 21, 2014, 62/168,001 filed May 29, 2015, and Ser. No. 14/617,054 filed Feb. 9, 2015, and/or 62/217,232 filed Sep. 11, 2015, all of which are incorporated by reference herein in their totality. If B were 424 in FIG. 6 and C were 424 in FIG. 12, then a more standard twist pattern might be seen in comparing the figures, which might happen with "randomization" for at least some positions of the yarns, even if not "twisted" as one would expect, such as by a twister, cabling, warpers, or other equipment.

FIGS. 11 and 12 are also useful to show relative yarn placement of the yarns. Assuming that the upper axis 472 would be a top most point of the bundle 474 when tufted, one will see that yarn A is more predominant in both FIGS. 11 and 12. C may not be visible at all in FIG. 11 as it is below A and B. Part of B and/or C may, or may not, be visible with relationship to FIG. 12 and certainly won't be as predominantly displayed as A due to their relative orientation below A. As the yarns A,B,C move relative to one another through the various processes as described herein and in the references incorporated by reference and others, on can see that a random or "striated" look can be created as can be seen from FIG. 10, the photograph. One half of a twist (or one yarn moving from toward the top 470 to toward a bottom (opposite 70)) over a few feet could still provide a noticeable striated pattern when tufted.

For some embodiments, the yarns 422-426 could be twisted, cabled, warped, or otherwise joined together such as up to one twist for every inch which would be tight for many applications but more likely one twist for every 12 inches or one twist for every 24 inches or even looser twists as could occur through the various twisting or randomization methods. One half twist over every 12 inches or 24 or even 48 inches, particularly if random in nature over that distance could still create a "striated" look. It is further anticipated that random twists or even reverse twisting such as twisting to the right, which is one twist for every 24 inches, or twisting left, which is one twist for every 24 inches, preferably without pre-knotting, in between changing twist directions could be accomplished through various methodologies. It is anticipated that a first twist direction could occur for up to 20 feet or more if not once every ten feet for those embodiments (and then switch). Random twists can be imparted from various techniques as well as predetermined changes in twists for various embodiments.

Although twist is certainly discussed as a means to quantify how the yarns are bundled relative to one another, randomization relates to the relative change in position and for many embodiments, the relative position of the yarns is likely to change over a predetermined length, such as one foot, it is likely that at least one of the yarns will have moved at least 30 degrees relative to the other (like the approximately 60 degrees yarn A is shown moved from FIGS. 11 to 12 or the approximately 90 degrees for yarn B, or the approximate 180 degrees for yarn C). It may be that the length this occurs may be more like two to four feet (approximately) for still other embodiments or other lengths of yarn bundles 474.

More likely, warpers may be used to warp multiple yarns together onto a single cone while blowing a fan onto the yarns so that as the yarns are fed onto the cone, the relative positions change, and then tend to reverse, so that over a 100 foot length there may be relatively no net twist, but in any individual segment of 10 feet, there is likely to be some variation as to the relative orientation of the yarns relative to one another.

Accordingly, another quantitative way to describe the yarn bundle 474 would be as provided to the needle 412, the gross twist over a two foot length is at least about 1/10 twist per foot (or 1/5, or 1/3, or 1/2 or even or two or more for some embodiments), or one twist per twenty feet for a 1/10 twist per foot, although over a hundred foot length, the net twist is likely to be no more than 2½ twists (i.e., 1/20 net twist) to account for randomization as described above and reverse twisting, etc. Net twist may also be no more than two twists or even one twist (on average) for similar lengths, particularly when beginning with the 1/10 twist per foot possible variation, particularly when imparted by randomization. Other embodiments may have other numerical figures (i.e., 1/5 twist per two foot might have no more than five twists per 100 foot, or 4, or 3, or 2, etc, and the other gross twists (as evaluated on a segment basis, might have proportional equivalents, or not).

Furthermore, for re-orientation, which could occur with more than two yarns A,B,C, it is anticipated that the relative placement of the yarns A,B,C, may change over a set length for at least some embodiments, such as, on average, within a length of 50 or 100 feet, or even within 1000 feet. This means that there is not necessarily a twist, but the relative placement of the yarns relative to one another changes (see the difference between FIGS. 11 and 12 where B is to the right of A FIG. 11, but to the left of A in FIG. 12. Additionally, for quantification purposes, it can be expressly claimed, for at least some embodiments, that the relative placement of yarns relative to one another (orientation) changes at least once as described in this paragraph every 200 feet, if not every hundred feet, if not every fifty feet (or even more often like every 40,30,20 or possibly even every 10 feet for some embodiments), at least on average for a length of at least five hundred feet.

For more quantification for at least some embodiments, the angular relationship of at least one yarn can change over a length relative to another. For instance, yarn A moves at least 30 degrees between FIGS. 11 and 12 relative to top 470 as discussed above. Accordingly, it can be claimed, for at least some embodiments, that a first yarn A (or 22) move at least 30 degrees (or at least 30 degrees, or possibly no more than 30 degrees) relative to bundle 472 in a 5 foot length, if not over a 10 foot length (or 20, or 50 foot length, etc. for various embodiments), and/or as an average of every 10 feet over a one hundred foot length, etc. Yarn B moves 180 degrees over a similar length (or at least 180 degrees, or possibly no more than 180 degrees), while yarn C moves about 90 degrees (or at least 90 degrees, or possibly no more than 90 degrees) over a similar length.

The lengths as expressed herein could relate to either the yarns bundle 474 as it is fed to the needle 412 and/or the length of any particular row, such as first row 30, as expressed quantitatively for claiming purposes.

As can be seen with reference to FIG. 9, there are preferably no gaps where there are no yarns in carpet 410. Although first, second and third yarns 422,424,426 are illustrated in the first row 430, in the second row there may be no variation of twist or there could be different variations of either a single yarn or multiple yarns tufted in the adjacent rows such as the rows between rows 430,440 and/or 442. The yarns 422-426 are also preferably not fused together or mechanically joined together along a length prior to the needle 412 (although are joined to the carpet 10 by tufting through the backing, applying latex and/or other processing step). Furthermore, carpet can certainly be cut into tiles for at least some embodiments.

In addition to first and second yarns 422,424 as shown in FIG. 6, as they show up predominantly in first row 430, another yarn, such as a fourth yarn 442, could show up in row 440, possibly along with a fifth yarn 444. One could understand in row 430 as well as row 440 that the third yarn 426, if utilized, could be hidden from view due to randomized twisting. The next yarn 426 which could now be a sixth yarn 446 shown in row 442 can be seen as reference to FIG. 9. Still other rows such as row 448 may be provided with a single yarn as a seventh yarn 450 or otherwise.

Figure 10:
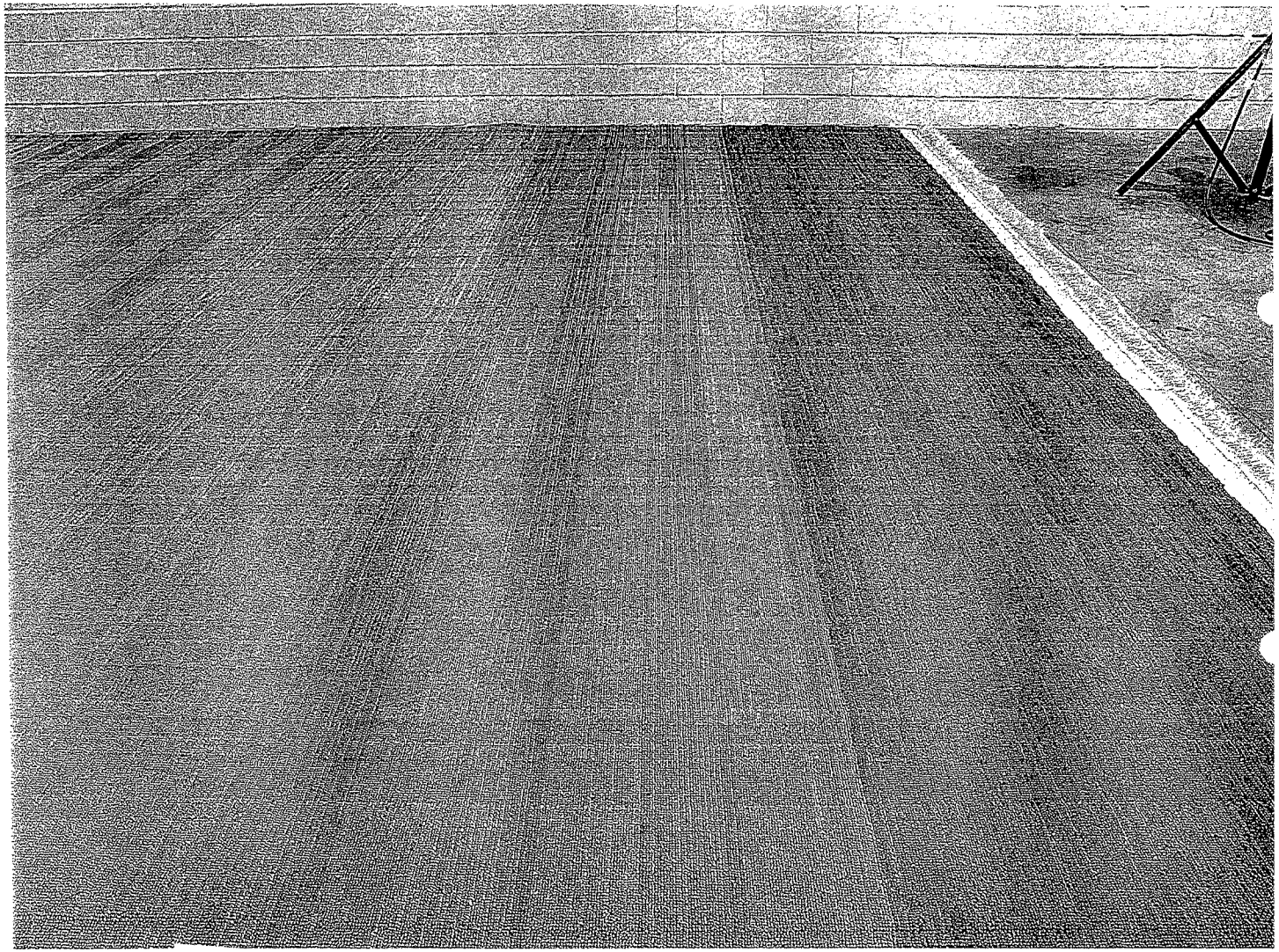
FIG. 10 is a photograph showing the striated effect of the presently preferred embodiment of the present invention.

As one can see with reference to FIG. 10, a lot of different yarns could be tufted with the various needles 412,418 and others across the carpet 410. Various elevations could also be tufted as will be explained below. More than three yarns 422-426 could be provided to needle 412 for tufting, such as four, five, or even more for some embodiments.

Accordingly, one may see in many embodiments a twist pattern could be random of the first, second and/or third yarns 422,424,426 as well as other combinations of any other yarns shown herein. Furthermore, although three yarns 422-425 are shown twisted, there certainly could be two yarns provided together from needle 412 and more than three yarns as would be understood by those of ordinary skill in the art as directed through each of the various needles 412,418.

The carpet of FIG. 10 is relatively impervious to bleach if not completely impervious to bleach since the yarns 422-426 are solution dyed yarns which are not subject to being dyed after tufting. Instead, these yarns are manufactured with a particular color as opposed to being designed to be able to accept color through a dyeing process. In addition to being impervious to bleach, they are also impervious to dyes and/or stains or at least substantially impervious thereto as would be understood by those of ordinary skill in the art.

Figure 8:
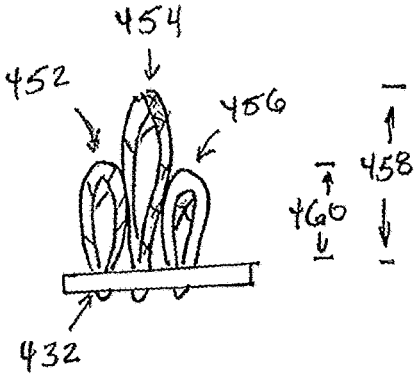
FIG. 8 shows a cross sectional view of a portion of carpet tufted in accordance with the methods of construction shown in FIG. 6 and FIG. 7.
Figure 9:
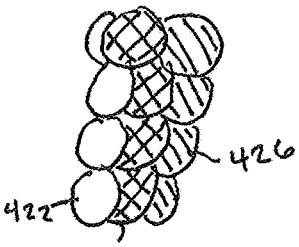
FIG. 9 shows three yarns being displayed at the front as opposed to just two.

In addition to the linear striation along a single height as is possibly shown in FIG. 7 as well as FIG. 10, it is also possible to elevate one tuft relative to another as is shown in FIG. 8 with a first tuft 452 tufted to a first height and the second tuft 454 tufted to a second height and then a third tuft 456 being tufted back to the first height 460 with the second height 458 being illustrated as well. By having elevations in height, one can create different patterns.

One can anticipate that the relative twisting of yarns could be relative loosely which is defined as less than one complete twist per six inches and in many embodiments less than one twist per twelve inches or one twist for 24 inches and that the twist rate will change over length, preferably constantly changing for many embodiments as described above and herein.

In addition to manufacturing carpet 410 according to the present preferred embodiment of the present invention, one can also manufacture carpet tile by cutting the carpet 410 into predetermined shapes which are normally rectangularly (i.e., square) after tufting. By having the striated look as is shown in FIGS. 2 and 5, the ability to provide carpet tiles is enhanced in that there is less likely to be a noticeable difference at the intersections of tiles.

It may be possible to provide extruded yarn calculated to be striated as it is provided from the spinnerets as a single yarn. When manufacturing these yarns, it may be that different filaments may be combined together so that the individual yarn strands provides the appearance of being striated along its length. However, these techniques would relate to a single yarn and not multiple yarns as directed through a single needle.

Figure 15:
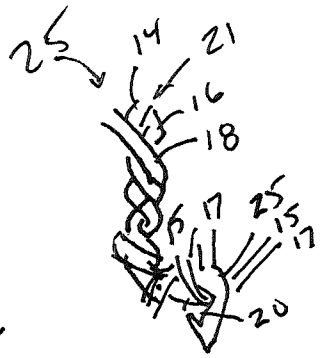
FIG. 15 is a portion of the perspective view shown in FIG. 1 with another arrangement of first, second and at least third, if not fourth and fifth yarns being directed through the eye of the needle.
Figure 14:
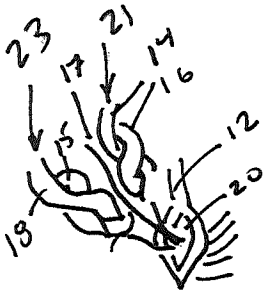
FIG. 14 is a portion of the perspective view as shown in FIG. 1 with another arrangement of first, second and at least third and fourth, if not fifth yarns being directed through the eye of the needle.
Figure 13:
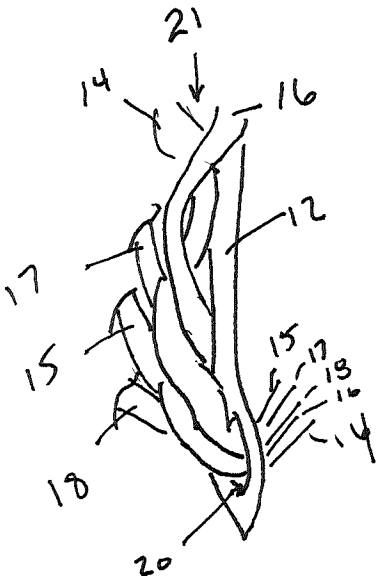
FIG. 13 is a portion of the perspective view shown in FIG. 1 with another arrangement of first, second and at least third, if not fourth and fifth yarns being directed through the eye of the needle.

FIGS. 13-15 show various ways of combining yarns 14,16,18,15 and 17 together at or before the eye 20 of the needle 12. FIG. 13 shows first and second yarns 14,16 twisted together as a first pair 21 joining third yarn 18, and possibly fourth and fifth yarns 15, 17 as well. FIG. 14 shows third and fourth yarns 18,15 twisted into a second pair 23 to join at the eye 20 of the needle 12, possibly together with optional fifth yarn 17. FIG. 15 shows somewhat of a trio 25 of yarns 14,16,18 which could be three with a predetermined twist rate, or even first and second yarns 14, 16 first twisted together and then third yarn 18 twisted about the first pair 21 to provide the trio 25. Similarly, trios 25 could be made of third, fourth and fifth yarns 18,15,17 as would be understood by those of ordinary skill in the art in an identical, similar or different manner. Meanwhile optional fourth and fifth yarns 15,17 are shown being fed to the eye 20 of the needle 12. The different way that the yarns combine at the needle 12 can affect how they are viewed as tufts such as 452, 454, 456 extending from backing 432 once tufted to make the carpet 32. Remember, not only can the yarns 14,16,18,15,17 have differing twist rates, but also be made up of different kinds of yarns, whether flat yarn, no twist yarn, and/or solution dyed heat set yarn as would be understood by those of ordinary skill in the art. Twist rates can be achieved through twisting, cabling, feeding together, piggybacking, feeding from different beams or cones, etc.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of manufacturing carpet comprising: twisting first and second yarns together as a first pair;

combining the first and second yarns with a third yarn by one of joining and twisting at or prior to a single eye of a needle; and directing the first, second and third yarns to the single eye of the needle, and combining the first, second, third yarn with a fourth yarn and a fifth yarn by one of joining and twisting at or prior to the single eye of the needle, to then tuft the first, second, third, fourth and fifth yarns into a backing to assist in providing a carpet with a needle.

2. The method of manufacturing carpet of claim 1 further comprising the step of twisting the third and fourth as a second pair, and further joining the fifth yarn with the first and second pair at the eye of the needle.

3. The method of manufacturing carpet of claim 1 wherein the third and fourth yarn are twisted as a second pair and the fifth yarn is twisted about the second pair at a predetermined twist rate.

4. The method of manufacturing carpet of claim 1 wherein the third, fourth and fifth yarns twisted as a trio with a predetermined twist rate.

5. The method of manufacturing carpet of claim 4 wherein the trio is combined with the first pair by joining at or before the eye of the needle.

6. The method of manufacturing carpet of claim 4 wherein the trio is twisted with the first pair with a predetermined twist rate.

7. The method of manufacturing carpet of claim 4 wherein the first, second and third yarns are selected from the group of flat, no twist and twisted yarn filament yarns.

8. The method of manufacturing carpet of claim 7 wherein the fourth yarn is selected from the group of flat, no twist and twisted yarn filament yarns.

9. The method of manufacturing carpet of claim 1 wherein the fifth yarn is selected from the group of flat, no twist and twisted yarn filament yarns.

10. The method of manufacturing carpet of claim 8 further comprising the step of joining the third and fourth yarn with the first pair at the eye of the needle.

11. The method of manufacturing carpet of claim 1 further comprising the step of twisting the third yarn to the first pair after twisting the first and second yarns to form the first pair with a predetermined twist rate of the third yarn about the first pair.

12. The method of manufacturing carpet of claim 11 further comprising the step of twisting the third and fourth yarn together as a second pair prior to combining with the first pair.

13. The method of manufacturing carpet of claim 12 further comprising the step of twisting the second pair to the first pair prior to the eye of needle at a predetermined twist rate.

14. The method of manufacturing carpet of claim 13 further comprising the step of joining the second pair with the first pair at the eye of the needle.

* * * * *